US006071156A

United States Patent [19]

Platzer et al.

[11] Patent Number: 6,071,156

[45] Date of Patent: Jun. 6, 2000

[54] SURFACE VESSEL WITH A FULLY SUBMERGED WATERJET PROPULSION SYSTEM

[75] Inventors: Gregory P. Platzer, Wrentham; Francesco Lanni, Walpole, both of Mass.

[73] Assignee: Bird-Johnson Company, Walpole, Mass.

[21] Appl. No.: 09/183,455

[22] Filed: Oct. 30, 1998

[51] Int. Cl.[7] ..... B63H 11/113

[52] U.S. Cl. ..... 440/42; 440/38

[58] Field of Search ..... 60/221; 440/38, 440/40–43, 47

[56] References Cited

U.S. PATENT DOCUMENTS

| | | | |
|---|---|---|---|
| 340,237 | 4/1886 | Nagel et al. | 440/41 |
| 3,241,770 | 3/1966 | Reynolds et al. . | |
| 3,776,173 | 12/1973 | Horwitz | 440/42 |
| 3,807,346 | 4/1974 | Delfeld . | |
| 4,026,235 | 5/1977 | Woodfill . | |
| 4,315,749 | 2/1982 | Baker et al. . | |
| 4,895,093 | 1/1990 | Dalsbö . | |
| 5,240,443 | 8/1993 | Futaki . | |
| 5,376,028 | 12/1994 | Koyanagi . | |
| 5,401,197 | 3/1995 | Kobayashi . | |
| 5,421,753 | 6/1995 | Roos . | |
| 5,505,640 | 4/1996 | Angulo | 440/43 |
| 5,520,133 | 5/1996 | Wiegert . | |
| 5,536,187 | 7/1996 | Nanami . | |

FOREIGN PATENT DOCUMENTS

| | | | |
|---|---|---|---|
| 3936598 | 6/1991 | Germany | 440/41 |

OTHER PUBLICATIONS

Chen, Benjamin Y–H, "Integrated Ducted Propulsor Concept," SNAME Symposium at Virginia Beach, Virginia, Sep. 17–18, 1991, pp. 19–1 to 19.10.

Dai, Charles, "Development of a Vertical Motor Propulsor," SNAME Symposium at Virginia Beach, Virginia, Sep. 23–24, 1997, pp. 1 to 19.

*Primary Examiner*—Ed Swinehart
*Attorney, Agent, or Firm*—Baker Botts L.L.P.

[57] ABSTRACT

A surface vessel has a hull that is configured to provide a mounting location for a waterjet pump propulsion system that is fully submerged under substantially all operating conditions of the vessel. A waterjet propulsion pump is mounted in an opening in the mounting location of the hull. At least the aft portion of the pump exit nozzle extends aft of the mounting location. A rotatable steering nozzle is coupled to the lower end of a rotatable steering shaft. A rotatable reversing deflector is coupled to the lower end of a rotatable reversing shaft that is either concentric with or parallel to the steering shaft. The steering shaft and reversing shaft extend upwardly through a shared opening or a pair of openings in the hull. Steering and reversing actuators associated with the steering and reversing shafts are located within the hull. A pair of steering deflectors in a "clamshell" relationship is an alternative.

6 Claims, 4 Drawing Sheets

SURFACE VESSEL WITH A FULLY SUBMERGED WATERJET PROPULSION SYSTEM

BACKGROUND OF THE INVENTION

Universally, waterjet propulsion systems are mounted on the main stern transoms of surface vessels with at least a portion of the pump and the pump exit nozzle above the surface of the water. That location permits the actuators for the steering nozzle and reversing deflectors of the propulsion system to be above the water, thus simplifying the installation and maintenance of the actuators and the hydraulic lines leading to the actuators. Also, it is common to provide access ports in the pump above the waterline to permit the pump to be serviced without drydocking the vessel.

Generally, the intake opening to the water supply conduit for the waterjet pump is located on the bottom of the hull a short distance forward of the transom and just far enough below the waterline to ensure that water is taken in under most operating conditions of the vessel—i.e., absent very severe pitching of the vessel due to heavy waves when intake may be briefly interrupted by surfacing of the opening. The location of the intake opening at a minimum height below the pump improves efficiency, as compared to a deeper location, by minimizing the vertical distance that the pump has to pump the water from the intake opening to the pump rotor.

A disadvantage of having the waterjet pump relatively close to the water surface is the reduced hydraulic head of water at the pump inlet. The reduced suction head reduces the capability of the pump to absorb high power at slow speeds due to the onset of cavitation. The pump has to be larger than it would have to be if the suction head were greater in order to provide high power output at slow speeds without cavitation.

Another disadvantage of previously known waterjet propulsion systems is the relative complexity of the actuators for the steering nozzle and the reversing deflectors and the outboard location of the actuators. The actuators are usually hydraulic piston/cylinders and require hydraulic lines that penetrate the hull. In the event of leakage, the hydraulic fluid contaminates the environment. The outboard actuators and the lines that serve them are vulnerable to damage from impacts.

SUMMARY OF THE INVENTION

An object of the present invention is to provide a surface vessel having a waterjet propulsion system that for any given size of waterjet pump is capable of absorbing more power at slow speeds without cavitation than previously known vessels propelled by water jets. Another object, which is of particular interest for military vessels, is to significantly reduce the noise generated by a waterjet propulsion system of a surface vessel. It is also an object to reduce the disturbance of the surface of the water by a waterjet propulsion system of a surface vessel, as compared to previously known waterjet propulsion systems. Yet another object is to provide actuators for the steering nozzle and reversing deflectors that are received entirely within the hull and are coupled to the steering nozzle and the reversing deflectors by elements that require only a minimum number of openings in the hull.

The foregoing objects are attained, in accordance with the present invention, by a surface vessel having a hull that is configured to enable a waterjet propulsion pump to be installed in a location that is fully submerged in substantially all operating conditions of the vessel. A water intake conduit is located in the hull forward of fully submerged installation location and has an inlet opening in the hull and an outlet opening within the hull adjacent the fully submerged installation location. A waterjet propulsion pump is mounted in the fully submerged installation location and is connected to the outlet of the conduit.

There are numerous ways of configuring the hull of a vessel to provide a suitable fully submerged site for installation of the waterjet pump. For example, a step can be created in the hull bottom forward of the transom that forms an "intermediate transom," which may extend along much of the width of the hull. Another configuration is a boxlike protuberance faired to an inclined aft portion of the hull and of a width sufficient to accept the pump. The installation site may also be a pod or similar appendage to the hull—a pod or similar appendage for purposes of this document is a portion of the hull.

Complete submersion of the waterjet pump, which is preferably located closer to the baseline than to the waterline, provides for a large hydraulic suction head at the pump, thus permitting a smaller pump to be provided without degradation of performance at slow speeds due to the onset of cavitation than would be required for a pump located at the waterline. The avoidance of cavitation and the submergence of the water jet reduce and attenuate noise markedly. Submergence of the water jet also reduces the amount of disturbance of the surface of the water in the wake of the vessel due to the water jet and the generation of white water.

The pump has an exit nozzle, at least a part of which is located outboard of the hull aft of the installation site of the pump, and a steering nozzle that is located entirely outboard of the hull aft of the exit nozzle. The steering nozzle may be mounted on the exit nozzle for pivotal movement about a steering pivot axis that lies in a substantially vertical plane that includes the exit nozzle axis. The pump, the exit nozzle and the steering nozzle, preferably, have a common axis and the steering pivot axis is perpendicular to the common axis. The common axis facilitates manufacture and assembly and avoids losses due to turning of the water flow as it passes through the pump.

The exit nozzle and a steering nozzle may be configured and oriented to discharge a water jet with a small downward velocity component in all conditions of forward propulsion of the vessel. The slight downward direction of the water jet minimizes perturbation of the jet by impingement of the jet on the portion of the hull bottom aft of the pump installation site and also contributes to noise attenuation and reduction in the magnitude and intensity of the wake due to the water jet—the water jet is driven somewhat downwardly into the water in the wake of the vessel and tends to dissipate well below the surface.

In some installations, as alluded to above, the hull location in which the pump is installed is an intermediate transom located forwardly of the main stern transom. The hull has an aft bottom section that extends between the intermediate transom and the main stern transom and that is located above the steering nozzle. The steering nozzle is coupled to the lower end of a steering shaft that extends upwardly through an opening in the aft bottom section, thus locating an upper end portion of the steering shaft within the hull.

A reversing deflector is coupled to the lower end of a rotatable reversing shaft, which may be spaced apart from the steering shaft, but is preferably tubular and concentric with the steering shaft. With a concentric reversing shaft, both the steering and reversing shafts penetrate the aft bottom section of the hull through a single opening. The reversing shaft has an upper end portion located within the hull.

A steering actuator received within the vessel hull is coupled to the upper end portion of the steering shaft.

Similarly, a reversing actuator received within the vessel hull is coupled to the reversing shaft. Although it is possible for the reversing actuator to be controlled separately from the steering actuator and moved in response to a separate control in coordination with the steering actuator, if necessary, it is highly advantageous for the reversing actuator to be coupled between the steering shaft and the reversing shaft so that the reversing shaft rotates with the steering shaft, regardless of the positions of the reversing deflector at the time of any rotation of the steering shaft.

The simplicity and durability of concentric or parallel shafts for moving and positioning the steering nozzle and reversing deflector or deflectors and the location of the actuators within the hull enable reductions in the costs of design, manufacture and installation, facilitate inspection and servicing, minimize possible loss of hydraulic fluid (in the case of hydraulic actuators) to the environment, and minimize the possibility of damage from impacts. All or most components outside the hull are mechanical, and the number of openings through the hull for steering and reversing control is minimized. The shaft design and inboard location of the actuators also provide design flexibility in the types and configurations of the steering and reversing actuators.

As described below, instead of a single reversing deflector and the associated reversing shaft and reversing actuator, the apparatus may have a pair of reversing deflectors that pivot outwardly with respect to the pump axis to inactive positions on opposite sides of the steering nozzle and pivot inwardly to an active position in which they meet edge to edge aft of the outlet of the steering nozzle. Each deflector in this configuration is coupled to the lower end of a reversing shaft. The two shafts may be tubular and concentric to each other and to the steering shaft or may be separate and parallel to each other and the steering shaft. The three shafts lead upwardly to a either a single opening or multiple openings in the hull and have upper end portions within the hull, to which actuators are connected.

DESCRIPTION OF THE DRAWINGS

For a more complete understanding of the present invention, and the advantages thereof, reference may be made to the following written description of exemplary embodiments, taken in conjunction with the accompanying drawings.

DESCRIPTION OF THE EMBODIMENT

Figure 1:
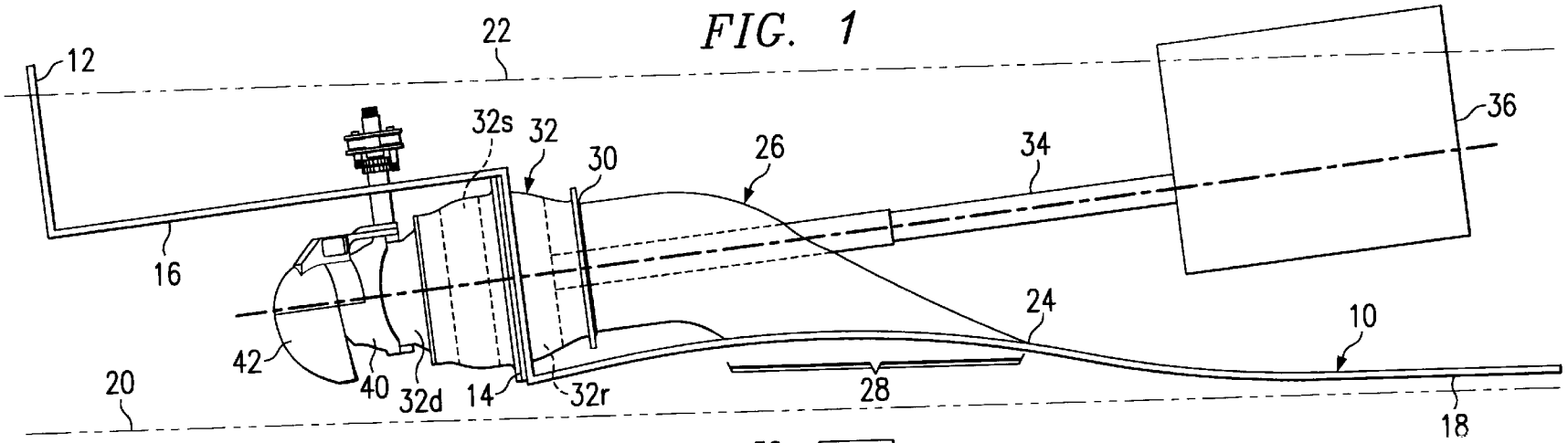
FIG. 1 is a schematic, partial side cross-sectional view of a vessel equipped with a waterjet propulsion system according to the present invention.
Figure 4:
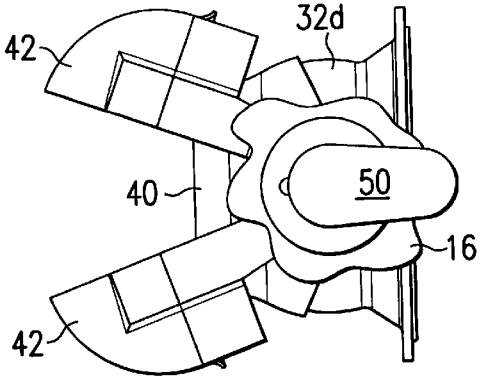
FIGS. 3, 4 and 5 are rear elevational, top plan and side elevational views, respectively, of the first embodiment of the steering and reversing apparatus, also showing it set for straight ahead propulsion.
Figure 3:
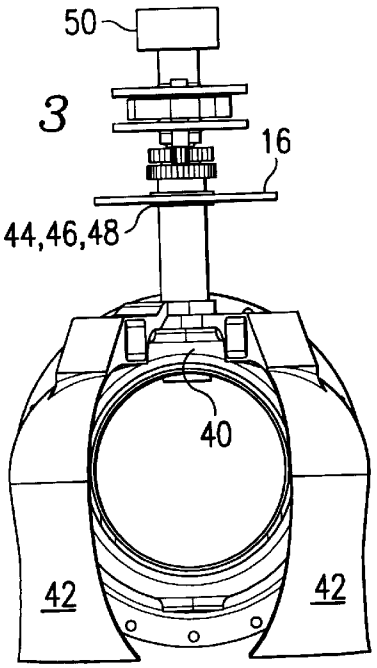
Figure 2:
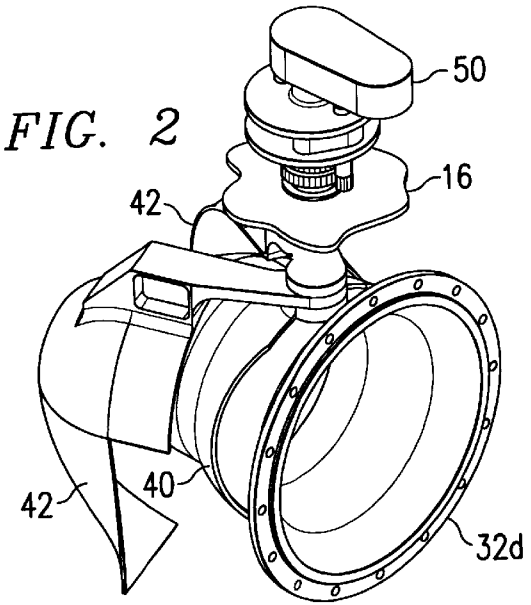
FIG. 2 is a schematic pictorial view of a first embodiment of a steering and reversing apparatus suitable for the propulsion system of FIG. 1, which comprises the exit nozzle, the steering nozzle, and reversing deflectors and the actuating systems for the steering nozzle and reversing deflectors, the view being taken from a vantage point ahead of, to starboard of, and above and showing the steering and reversing apparatus set for straight ahead propulsion.
Figure 5:
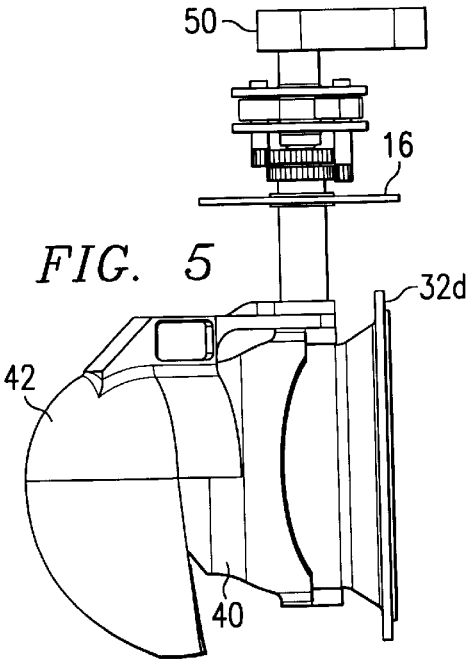
Figure 6:
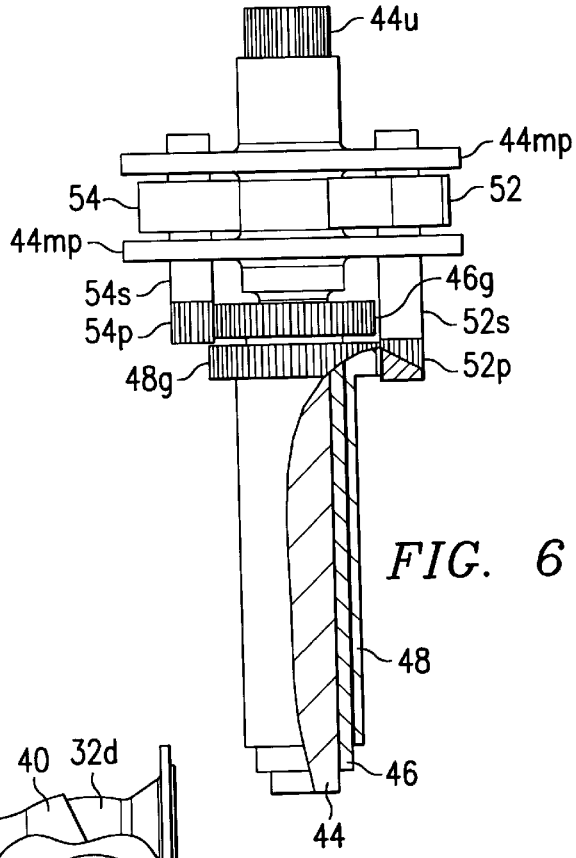
FIG. 6 is a schematic elevational view of a portion of the actuating system for the steering nozzle and reversing deflectors of the first embodiment, a portion being broken out in cross-section.

FIG. 1 shows in outline form the lower aft portion of the hull 10 of a surface vessel. The hull includes a main stern transom 12, an intermediate transom 14 that forms the fully submerged mounting location for a waterjet pump, and an aft bottom section 16 that extends from the lower edge of the main transom forwardly to the upper edge of the intermediate transom. The foregoing construction might be called a stepped transom. The major part 18 of the hull bottom, forward of the intermediate transom 14, lies close to the baseline 20 of the hull. The entire intermediate transom 14 is submerged well below the water line 22, such that in substantially all operating conditions of the vessel it remains fully submerged.

A section 24 of the hull bottom forward of the juncture with the lower edge of the intermediate transom 14 is located above the base line and faired slightly upwardly and then downwardly to meet the main section 18. The configuration of the section 24 of the hull may be varied from that shown in the drawing as a matter of hydrodynamic design. An intake conduit 26 leads from an inlet opening 28 in the section 24 to a flanged outlet opening 30 adjacent the intermediate transom 14. A waterjet pump 32 is installed in an opening in the intermediate transom 14. A drive shaft 34 that is driven by a prime mover 36, which may be a gasoline or diesel engine, a gas turbine, an electric motor, etc., leads into the conduit 26 and is coupled to the rotor 32*r* of the pump 32. It is also possible for the waterjet pump to be rim-driven. A bearing for the tail end of the shaft 34 is located within the stator 32*s* of the pump.

The aft portion of the pump 32 protrudes from the intermediate transom 14, thus locating the aft portion of the pump housing and the pump exit nozzle 32*d* aft of the transom 14. A steering nozzle 40 is mounted on the exit nozzle (or on elements of the pump housing overlying the exit nozzle) for rotation about an axis that lies in a vertical plane that includes the pump exit nozzle axis. A pair of reversing deflectors 42 are mounted on the exit nozzle for rotation about the same axis as the steering nozzle. The drive shaft 34, the pump 32 and the pump exit nozzle are aligned axially and are inclined slightly downward from fore to aft. The common pivot axis of the steering nozzle 40 and the reversing deflectors 42 lies perpendicular to the axis of the pump exit nozzle.

The vessel may, of course, have more than one prime mover 36 and associated waterjet propulsion pumps 32 arranged generally abreast of each other. When there are multiple prime movers and propulsion systems, not all of them need be steerable or reversible—e.g., a center mover/pump of a three unit installation may be neither steerable nor reversible.

Referring to FIGS. 2 to 6, the lower end of a steering shaft 44 is coupled to the steering nozzle 40. The steering shaft 44 is coaxial with the common pivot axis of the steering nozzle 40 and the reversing deflectors 42. The lower end of one of two reversing shafts 46 and 48, which are concentric with each other and with the steering shaft 44, is coupled to one of the two reversing deflectors 42 and the lower end of the other reversing shaft is coupled to the other reversing deflector. The three concentric shafts 44, 46 and 48 extend upwardly from the steering nozzle and reversing deflectors through an opening in the aft bottom portion 16 of the hull. The upper end portion 44*u* of the steering shaft and upper end portions of the reversing shafts 46 and 48 lie above the aft bottom section 16 within the hull.

A steering actuator 50 coupled to the steering shaft 42 drives the steering shaft in rotation to change the direction of the water jet that emerges from the steering nozzle 40. Reversing actuators 52 and 54 coupled between the steering shaft 44 and the respective reversing shafts 46 and 48 drive the reversing shafts in rotation relative to the steering shaft 44. The actuators 52 and 54 are carried by a pair of mounting plates 44*mp* that are affixed to the steering shaft 44. The output shafts 52*s* and 54*s* of the actuators 52 and 54 are coupled to the reversing shafts 46 and 48 by drive pinions 52*p* and 54*p* on the output shafts 52*s* and 54*s* and driven gears 46*g* and 48*g* on the respective steering shafts.

For straight ahead operation (FIGS. 2 to 5), the reversing deflectors 42 are positioned laterally on either side of the outlet opening of the steering nozzle. The steering nozzle 40 is positioned by the actuator 50 to reside in axial alignment with the pump exit nozzle 32*d*. The effect of having the water jet from the pump directed aft with a downward velocity component is discussed above.

Figure 11:
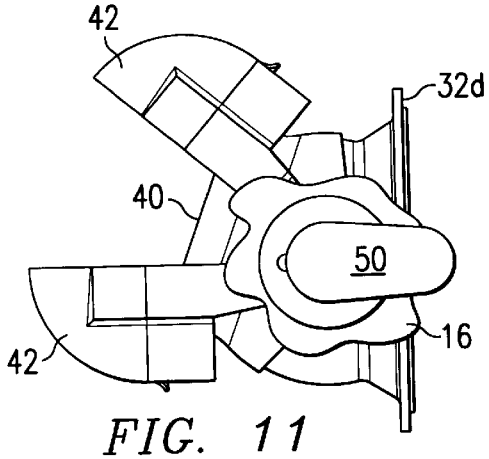
Figure 13:
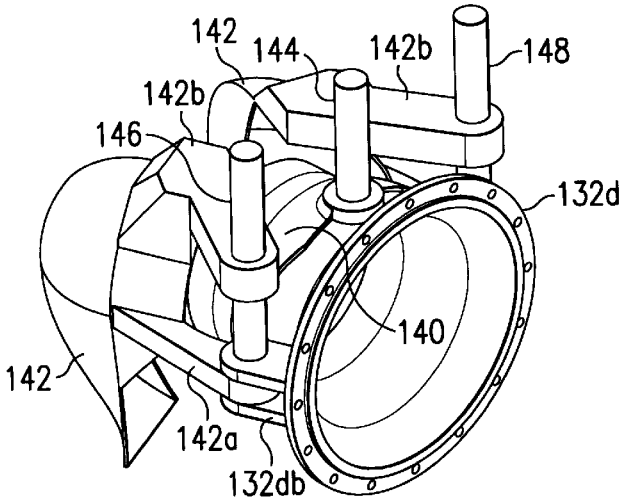
FIG. 13 is a generally schematic pictorial view of a second embodiment of steering and reversing apparatus useful in the present invention, the view being taken from a vantage point ahead of, to starboard of, and above and showing the apparatus set for straight ahead propulsion.
Figure 12:
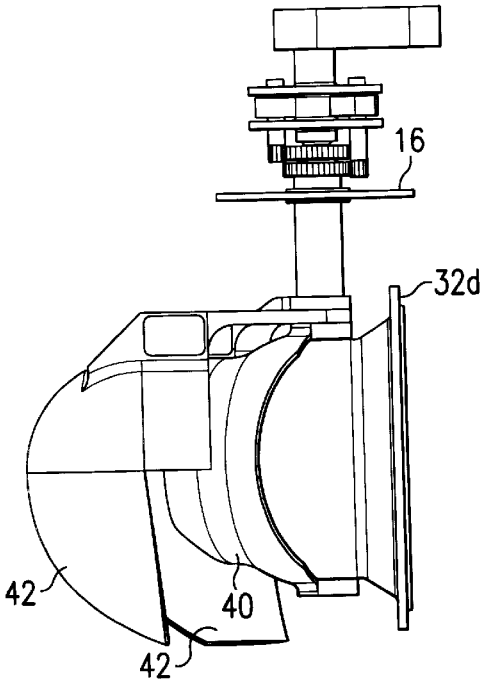
Figure 14:
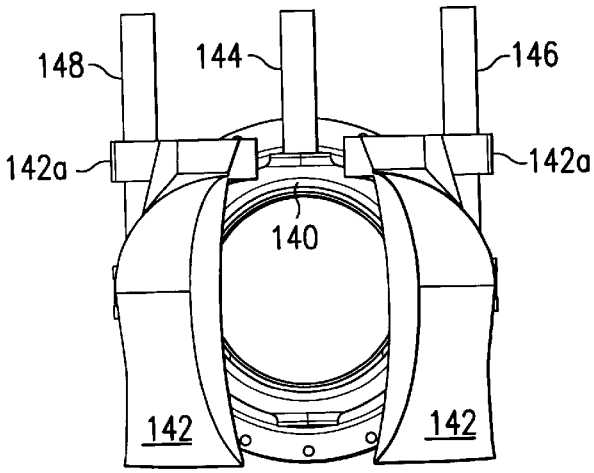
FIGS. 14, 15 and 16 are rear elevational, top plan and side elevational views, respectively, of the second embodiment, also showing it set for straight ahead propulsion.
Figure 15:
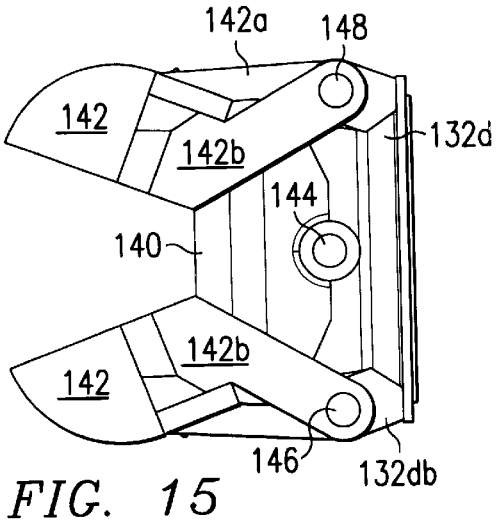
Figure 16:
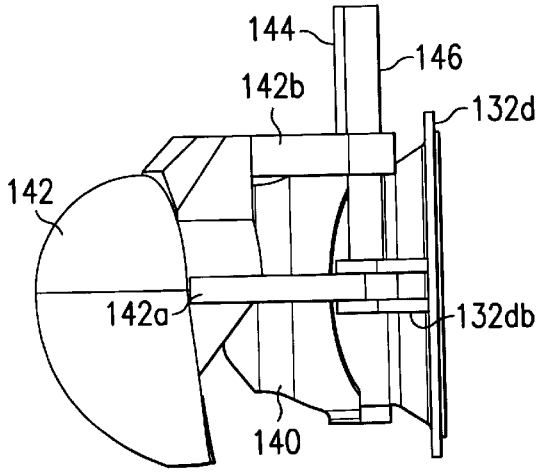
Figure 17:
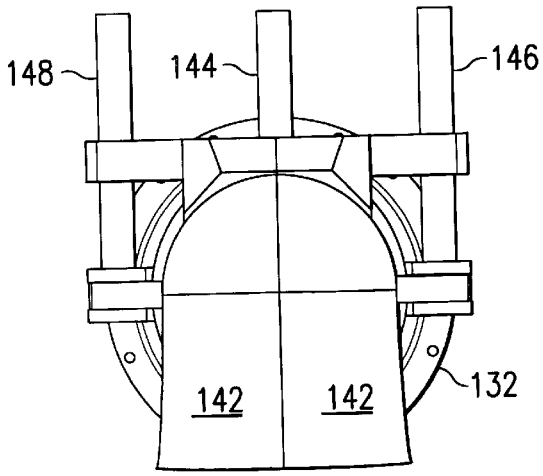
FIGS. 17, 18 and 19 are rear elevational, top plan and side elevational views, respectively, of the second embodiment, showing it set for straight reverse propulsion.
Figure 18:
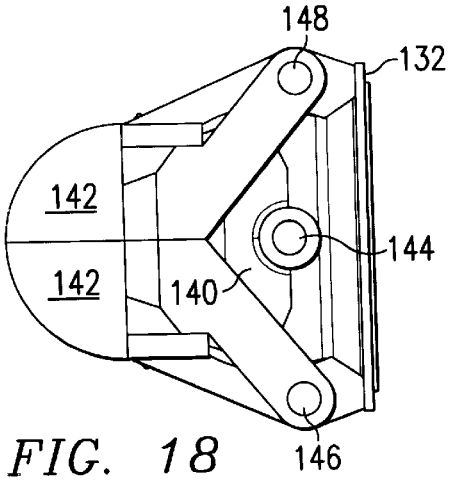
Figure 19:
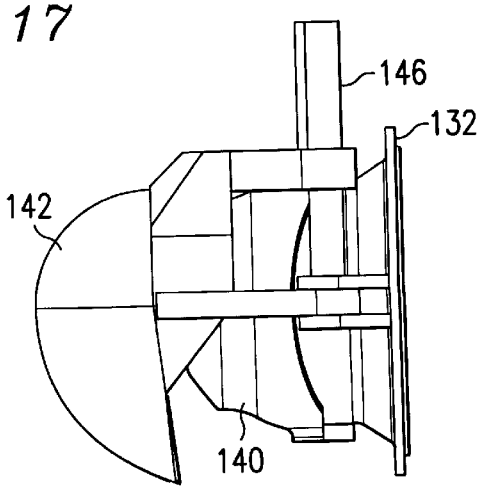

For forward turning to port of the vessel, the steering actuator 50 is operated to rotate the steering shaft clockwise (as viewed from above, FIG. 11) and turn the steering nozzle to port, thus to deflect the water jet emerging from the pump exit nozzle 32*d* from the axial direction to a direction aftward and to port. Note that the reversing deflectors 42 rotate with the steering nozzle.

Figure 8:
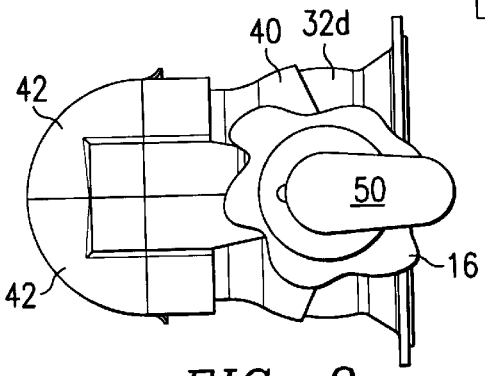
FIGS. 7, 8 and 9 are rear elevational, top plan and side elevational views, respectively, of the first embodiment of the steering and reversing apparatus, showing it set for straight reverse propulsion.
Figure 7:
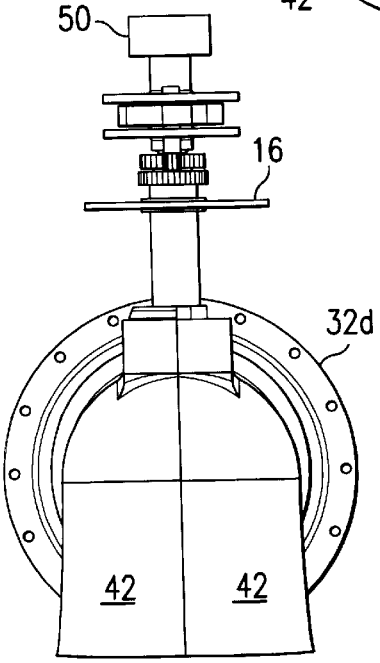
Figure 9:
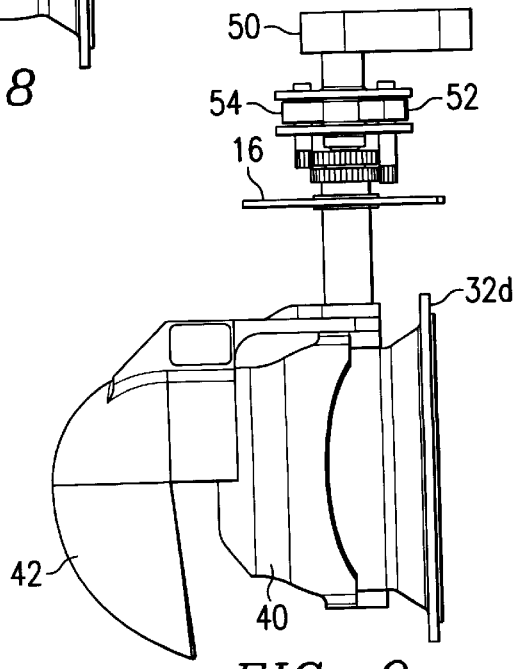
Figure 10:
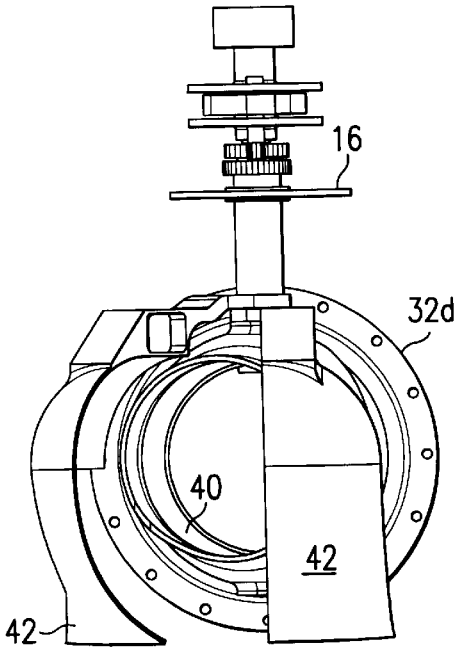
FIGS. 10, 11 and 12 are rear elevational, top plan and side elevational views, respectively, of the first embodiment of the steering and reversing apparatus, showing it set for port ahead propulsion.

For reverse operation of the propulsion system, the actuators 52 and 54 are operated, thus to impart rotation to the reversing shafts 46 and 48 in a direction to move the reversing deflectors toward each other to a closed position, in which they meet and form a scoop that turns the water jet so that it is directed forwardly (FIGS. 7 to 9). If the steering actuator is operated with the reversing deflectors 42 closed for reverse operation of the propulsion unit, reverse operation with a lateral vector component is provided. As is known per se, multiple water jet propulsion units of a vessel can be set to various combinations of forward and reverse operation of multiple water jets to provide many motions of the vessel. An important advantage of waterjet propulsion is a high degree of maneuverability imparted to the vessel.

The drawings depict generally schematically rotary hydraulic actuators 50, 52, 54 for rotating the shafts 44, 46 and 48. Other types of actuators—both hydraulic/mechanical and electric/mechanical—can, of course, be used. The location of the steering and reversing actuators within the hull makes many variations in the types and designs of the actuators readily attainable.

A second embodiment of steering and reversing apparatus suitable for use in a vessel according to the present invention, which is shown in FIGS. 13 to 19, is the same in most respects as the first embodiment of FIGS. 2 to 12. Accordingly, the same references numerals, but increased by 100, are applied to FIGS. 13 to 19 as are used in FIGS. 2 to 12. Most of the above description of the first embodiment is applicable to the second embodiment.

The steering nozzle 140 is mounted on the exit nozzle 132*d* for pivotal movement about an axis that lies in a vertical plane that includes the axis of the exit nozzle 132*d* and is coupled to the lower end of a steering shaft 44. A pair of reversing deflectors 42 are mounted for pivotal movement about pivot axes that are spaced apart from and parallel to the steering pivot axis. In particular, each steering deflector 142 has a lower mounting arm 142*a* that is coupled to the lower end of a reversing shaft 146, 148 and an upper arm 142*b* that is also coupled to the reversing shaft 146, 148. The steering and reversing shafts 144, 146 and 148 extend upwardly through openings in the vessel hull above the exit nozzle and have upper end portions within the hull see FIG. 1). Suitable actuators (not shown) that are located inboard of the hull rotate the respective shafts 144, 146 and 148 in the manner described above in conjunction with the first embodiment to maneuver the vessel.

Among possible modifications of the embodiments shown in FIGS. 2 to 19 and described above is a reversing shaft that is concentric to the steering shaft and is coupled to a pair of reversing deflectors, one on either side of the steering/reversing apparatus, by crank arms on the reversing shaft that extend fore to aft and links connecting the crank arms to the two reversing deflectors.

The steering and reversing apparatus described above is useful not only in water jet-propelled surface vessels in which the waterjet pumps are fully submerged but in surface vessels in which the waterjet pumps are at or near the waterline and in submersible vessels.

What is claimed is:

1. A surface vessel comprising, a hull having an aft portion that includes a main stern transom, an intermediate transom that is fully submerged under substantially all conditions of operation of the vessel and an aft bottom section that extends from the lower edge of the main stern transom forwardly to the upper edge of the intermediate transom;

a water intake conduit having an inlet opening in the hull forward of the intermediate transom and an outlet opening within the hull forward of the intermediate transom;

a waterjet propulsion pump having a housing mounted in an opening in the intermediate transom and connected forward of the intermediate transom to the outlet of the intake conduit, an aft portion of the propulsion pump, including an exit nozzle of the pump, extending aft from the intermediate transom and being located below the aft bottom section of the hull; and a steering nozzle pivotally mounted on the exit nozzle and coupled to the lower end of a steering shaft that extends upwardly from the steering nozzle through an opening in the aft bottom section and has an upper end portion located within the hull.

2. The vessel according to claim 1 and further comprising a steering actuator received within the vessel hull and coupled to the upper end portion of the steering shaft.

3. The vessel according to claim 1 wherein a portion of the pump housing containing a stator is located aft of the intermediate transom and a portion of the pump housing containing a rotor is located within the hull forward of the intermediate transom.

4. The vessel according to claim 3 wherein the pump is a mixed flow pump.

5. The vessel according to claim 3 wherein the pump is an axial flow pump.

6. The vessel according to claim 3 wherein the pump, the exit nozzle and the steering nozzle have a common axis, the common axis slopes downwardly and rearwardly at an acute angle relative to the base line of the hull, and the steering pivot axis is perpendicular to the common axis.

* * * * *